United States Patent [19]

Schwarzschild

[11] 4,233,679

[45] Nov. 11, 1980

[54] ADJUSTABLE PIEZOELECTRIC TRANSDUCER FOR A WATCH

[75] Inventor: Jack Schwarzschild, Stamford, Conn.

[73] Assignee: Timex Corporation, Waterbury, Conn.

[21] Appl. No.: 79,756

[22] Filed: Sep. 28, 1979

[51] Int. Cl.[3] ..... G04B 21/10; G04C 21/38; G08B 3/00

[52] U.S. Cl. ..... 368/72; 368/245; 368/276; 340/384 E

[58] Field of Search ..... 58/21.12, 38 R, 53-55, 58/57.5, 88 R; 340/384 E

[56] References Cited

U.S. PATENT DOCUMENTS 4,068,461 1/1978 Fassett et al. ..... 58/57.5

*Primary Examiner*—Edith S. Jackmon

*Attorney, Agent, or Firm*—William C. Crutcher

[57] ABSTRACT

A watch includes a piezoelectric wafer mounted on a membrane held by its peripheral edge inside a watch caseback. A frequency adjustment device mounted in the caseback includes a rotatable arm contacting the membrane and movable to adjust the resonant frequency of the membrane and piezoelectric crystal vibrating assembly. The frequency of the piezoelectric transducer may be adjusted to match a desired frequency of an electrical or sound signal.

4 Claims, 3 Drawing Figures

ADJUSTABLE PIEZOELECTRIC TRANSDUCER FOR A WATCH

This invention relates to a piezoelectric transducer suitable for a watch. More particularly, the invention relates to frequency adjustment mechanism for changing the resonant frequency of a vibrating piezoelectric crystal and membrane assembly in a watch.

Wristwatches are known which incorporate a piezoelectric crystal mounted on a membrane held by its peripheral edge for creating an audible sound. A number of illustrative patents are included in the following list, which is not intended to be all inclusive, but merely exemplary of the prior art.

U.S. Pat. No. 3,788,060-Kawamura—Jan. 29, 1974.
U.S. Pat. No. 3,940,919-Yasuda et al—Mar. 2, 1976.
U.S. Pat. No. 4,004,409-Ganter et al—Jan. 25, 1977.
U.S. Pat. No. 4,045,954-Ganter et al—Sept. 6, 1977.
U.S. Pat. No. 4,068,461-Fassett et al—Jan. 17, 1978.

The foregoing constructions utilize a piezoelectric crystal mounted on a membrane to convert electrical signals from an oscillator into vibratory motion creating audible sound. Since the sound volume is dependent upon the motion of the membrane, it is customary to drive the membrane at or near its resonant frequency to create maximum sound. Since some oscillators are designed to operate at a fixed frequency and since there are minor variations in manufacture of the piezoelectric and membrane assemblies, it would be desirable to be able to adjust the resonant frequency of the piezoelectric oscillator mechanically to match the oscillator for optimum energy transfer.

A lesser known use of piezoelectric crystals in watches comprises the converse of the above. Here the membrane is set in motion by sound waves and the accompanying motion of the piezoelectric crystal creates electrical input signals which may be used for various purposes in a watch. Electrical signals may be generated by voice, by coded digital audio signals over telephone lines, by striking the watch case, by audible radio signals, or in other equivalent ways to set the membrane into vibratory motion. The electrical signals may actuate the switches to set the watch, update the watch, create a special display, etc. U.S. Pat. No. 4,078,376—Freemen, issued Mar. 14, 1978 suggests a piezoelectric transducer used as an input device. U.S. Pat. No. 3,919,834—Murakami issued Nov. 18, 1975, described a watch with a transducer which can operate as a microphone. Piezoelectric transducers functioning either as a microphone or as sound generators are well known in the electronics art, as illustrated by U.S. Pat. No. 4,035,672—Beaverson et al, issued July 12, 1977. Finally, U.S. Pat. No. 4,020,628 issued May 3, 1977 to Vittoz suggests setting a watch from a telephone signal utilizing a piezoelectric transducer as a microphone.

When employing the piezoelectric transducer as an input device in a watch, the frequency of the audio input signal may be predetermined at a fixed frequency. Should the resonant frequency of the piezoelectric transducer in the watch not coincide, the energy transmitted to the transducer might be insufficient to generate the necessary electrical signals. Therefore it is desirable to have a means to adjust the resonant frequency of the piezoelectric transducer in the watch.

U.S. Pat. No. 4,079,213—Bage et al, issued Mar. 14, 1978, and U.S. Pat. No. 3,733,804—Diersbock, issued May 22, 1973, (the latter assigned to the present assignee) show means of mounting piezoelectric crystal membranes to vibrate in various modes. Devices for adjusting electromagnetic buzzers are known from U.S. Pat. No. 3,462,943 issued Aug. 26, 1969 to Spadini and U.S. Pat. No. 3,863,437 issued Feb. 4, 1975 to Barth et al (the latter assigned to the present assignee). These latter constructions are not suitable for adjusting the frequency of a piezoelectric transducer in a watch.

Accordingly, one object of the present invention is to provide an improved adjustable piezoelectric transducer for a watch.

Another object of the invention is to provide an improved means for adjusting the frequency and vibratory mode of a piezoelectric transducer.

DRAWING

The invention both as to organization and method of practice, together with further objects and advantages thereof, will best be understood by reference to the following description, taken in connection with the accompanying drawings, in which:

FIG. 1 is a cross-sectional elevation view of a watch with a piezoelectric transducer, FIG. 2 is an enlarged cross-sectional drawing of a portion of FIG. 1, and FIG. 3 is a plan view taken along lines III—III of FIG. 1.

SUMMARY OF THE INVENTION

Briefly stated, the invention comprises an improvement in a watch having a case, a caseback, a membrane retained by its peripheral rim between the case and caseback and carrying a piezoelectric element operatively connected to electrical circuitry in a watch movement, the improvement comprising frequency adjustment means disposed in the caseback accessible from the exterior of the watch, said frequency adjustment means including a movable element disposed within the watch case and having a portion contacting the membrane and adapted to be adjustably positioned at variable radial locations on the membrane to adjust its vibrational mode and resonant frequency.

DESCRIPTION OF THE PREFERRED EMBODIMENT

Figure 1:
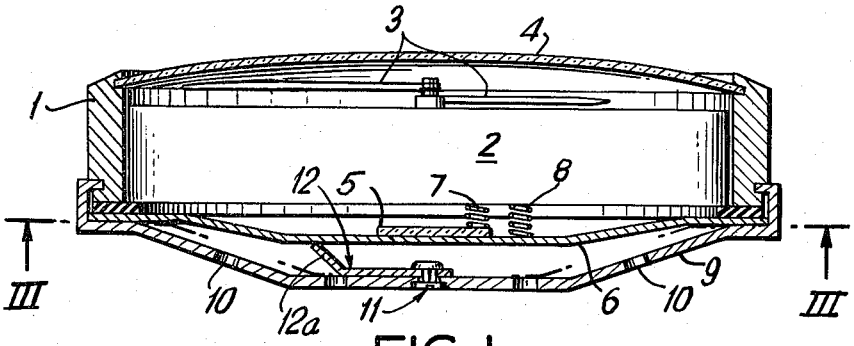

Referring now to FIG. 1 of the drawing, a watch case 1 contains a watch movement 2, with means to display the time, such as hands 3, and a protective crystal 4. The movement 2 contains a power source such as a button cell (not shown) and electronic circuitry (not shown). A piezoelectric wafer 5 attached by cementing to a thin metallic disc-shaped membrane 6 serves as a piezoelectric transducer. The transducer is electrically connected to the electronic circuitry within the movement 2 by means of conductive springs 7,8. The details of the electronic circuitry within movement 2 are not material to the present invention, and hence are not described in detail. If the piezoelectric transducer is being driven to produce an audible sound, the circuitry in watch movement 2 includes a oscillator providing alternating electrical output pulses to the piezoelectric crystal via contact springs 7,8. If the piezoelectric transducer is serving as a microphone or input element, vibratory motion caused by sound waves causes the crystal to generate electrical impulses transmitted via springs 7,8 to the electronic circuitry to perform preselected functions.

The peripheral edge of membrane 6 is held in place by a watch caseback 9, which includes ports 10 to either admit or emit audible sound waves.

In accordance with the present invention, a frequency adjusting means 11 is disposed in the caseback 9 and including a movable element 12 having a portion contacting the membrane 6 inside the watch. The adjusting frequency means 11 is accessible from outside the watch and acts to change the radial position of the pressure exerted on the underside of membrane 6 so as to affect its vibratory characteristics and its natural frequency. The term "radial" refers to the direction outward from the center of the disc-shaped membrane.

Figure 2:
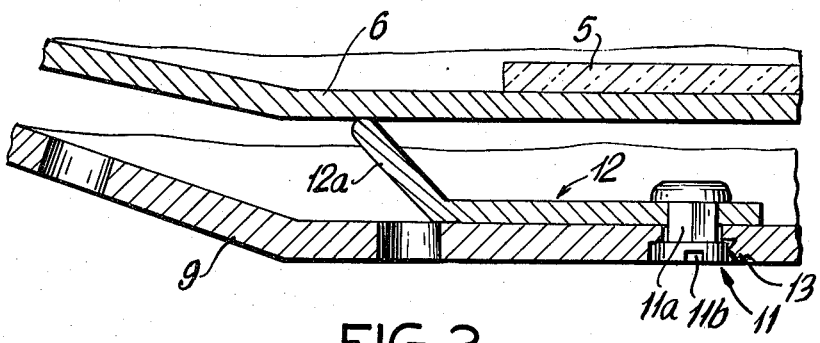

Referring to FIG. 2 of the drawing, the details of the preferred embodiment of the invention are illustrated. The frequency adjusting means 11 includes a pin or rivet member with a square shank 11*a* and a slotted head 11*b* for adjustment with a screwdriver outside the watch case. The movable element 12 inside the case includes an arm with a flexible finger 12*a* exerting light pressure on the underside of membrane 6. The means for holding the arm 12 in place after adjustment are shown as a stake 13.

Figure 3:
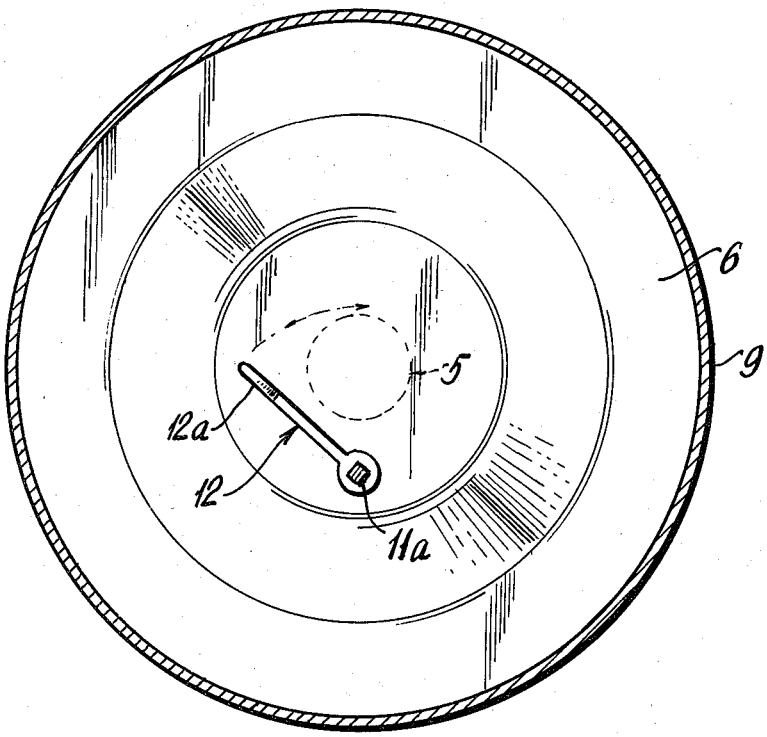

Referring now to the plan view of FIG. 3 of the drawing, it will be noted that the frequency adjusting means 11 is located off-center from the center of the disc-shaped membrane 6. Therefore rotation of arm 12 will move the point of pressure to varying radial locations from center of disc 6.

OPERATION

In operation, the piezoelectric transducer comprising piezoelectric crystal 5 and membrane 6 vibrate in a rather complex mode, generally with one or more concentric circular modes, since the disc is held at its peripheral rim. Movement of the arm 12 changes the vibratory pattern and natural frequency of the disc, as well as affecting the location of the nodes. The arm 12 is adjusted so that the resonant frequency of membrane 6 and its associated assembly either matches the audio frequency of the desired input signal, or so that it matches the output frequency of its driving oscillator if it is functioning as an alarm.

EXAMPLES

Several transducers were manufactured in accordance with the design shown for watch size devices. The resonant frequency range adjustments for four devices were as follows:

| SAMPLE NO. | MAX. FREQ. (HZ) | MIN. FREQ.(HZ) |
|---|---|---|
| 1 | 2532 | 2083 |
| 2 | 2512 | 2074 |
| 3 | 2473 | 2067 |
| 4 | 2425 | 2040 |

The foregoing construction allows a very simple adjustment to be made from the outside of the watch to change the frequency of a piezoelectric transducer inside the watch, thereby improving its performance as an alarm watch or as an input device for controlling the operation of the watch from external sound signals of a predetermined frequency.

Although there has been described what is considered at present to be the preferred embodiment of the invention, other modifications will occur to those skilled in the art, and it is desired to included in the apended claims all such modifications as fall within the true spirit and scope of the invention.

What is claimed is:

1. In a watch having a case containing a movement, a power source, and electric circuitry, a piezoelectric transducer comprising a flexible disc-shaped membrane and a piezoelectric wafer attached thereto, and a caseback enclosing the watch movement within the case, the improvement comprising:

frequency adjustment means disposed within said caseback and accessible from the exterior of the watch case, said frequency adjustment means including a movable element disposed within the watch case and having a portion contacting said membrane, said element being movable so as to contact said membrane at varying radial locations when said frequency adjustment means is actuated outside the watch to change the vibratory characteristics of said piezoelectric transducer.

2. The combination according to claim 1, wherein said frequency adjustment means comprises a rotatable pin having an arm terminating in a flexible finger disposed on the pin.

3. The combination according to claim 2, wherein said membrane is supported by its peripheral edges, and wherein said pin is disposed at a location off-center from the center of the membrane, whereby rotation of the pin causes the finger to contact the membrane at varying radial locations.

4. The combination according to claim 2, wherein said piezoelectric transducer is electrically connected to the circuitry in the watch movement by flexible conductive spring members.

* * * * *